US008978742B2

(12) United States Patent
Lin et al.

(10) Patent No.: US 8,978,742 B2
(45) Date of Patent: Mar. 17, 2015

(54) HEAT CONDUCTING STRUCTURE WITH COPLANAR HEATED PORTION, MANUFACTURING METHOD THEREOF, AND HEAT SINK THEREWITH

(71) Applicants: CPUMATE Inc., New Taipei (TW); Golden Sun News Techniques Co., Ltd., New Taipei (TW)

(72) Inventors: Kuo-Len Lin, New Taipei (TW); Chen-Hsiang Lin, New Taipei (TW); Ken Hsu, New Taipei (TW); Chih-Hung Cheng, New Taipei (TW)

(73) Assignees: Cpumate Inc., Taipei (TW); Golden Sun News Techniques Co., Ltd., Taipei (TW)

( * ) Notice: Subject to any disclaimer, the term of this patent is extended or adjusted under 35 U.S.C. 154(b) by 0 days.

(21) Appl. No.: 13/716,149

(22) Filed: Dec. 16, 2012

(65) Prior Publication Data

US 2013/0098584 A1 Apr. 25, 2013

Related U.S. Application Data

(62) Division of application No. 12/562,352, filed on Sep. 18, 2009, now Pat. No. 8,484,845.

(51) Int. Cl.

| | |
|---|---|
| ***H05K 7/20*** | (2006.01) |
| ***B21D 53/08*** | (2006.01) |
| ***F28D 15/04*** | (2006.01) |

(Continued)

(52) U.S. Cl.

CPC ..... *F28D 15/043* (2013.01); *B21D 53/08* (2013.01); *B21D 22/06* (2013.01); *F28D 15/0266* (2013.01); *F28F 1/32* (2013.01); *F28D 15/0275* (2013.01); *B21D 22/025* (2013.01)

USPC ..... 165/104.21; 29/890.03; 65/104.33; 65/182; 65/151

(58) Field of Classification Search

USPC ..... 29/890.03; 165/104.19, 104.21, 104.33, 165/181, 182, 183, 151, 154, 172; 361/700

See application file for complete search history.

(56) References Cited

U.S. PATENT DOCUMENTS 3,666,006 A * 5/1972 Valyi ..... 165/164
4,771,825 A * 9/1988 Chen et al. ..... 165/151

(Continued)

FOREIGN PATENT DOCUMENTS

JP 2006269629 A 10/2006
TW 458501 4/2013

OTHER PUBLICATIONS

Taiwan Official Action issued on Mar. 15, 2013.

*Primary Examiner* — David Bryant
*Assistant Examiner* — Jason L Vaughan
(74) *Attorney, Agent, or Firm* — Chun-Ming Shih; HDLS IPR Services

(57) ABSTRACT

A heat conducting structure, a heat sink with the heat conducting structure, and a manufacturing method of the heat conducting structure are disclosed. The manufacturing method includes the steps of providing a first mold (20) and a second mold (30) having different concave cambers (211, 211*a*, 221, 221*a*), using the first mold (20) to progressively compress the heat pipes (10) and form a camber (112) at an evaporating section (11), using the second mold (30) to compress the camber (112) to form a contact plane (112') and an attaching plane (113') perpendicular to each other, coating an adhesive (50) on the contact planes (112'), connecting the contact planes to make the attaching planes co-planar.

4 Claims, 16 Drawing Sheets

(51) Int. Cl.

| | |
|---|---|
| ***B21D 22/06*** | (2006.01) |
| ***F28D 15/02*** | (2006.01) |
| ***F28F 1/32*** | (2006.01) |
| ***B21D 22/02*** | (2006.01) |

(56) References Cited

U.S. PATENT DOCUMENTS

| | | | | |
|---|---|---|---|---|
| 7,562,696 | B2 * | 7/2009 | Lin et al. | 165/104.33 |
| 7,597,134 | B2 * | 10/2009 | Min et al. | 165/80.3 |
| 7,746,642 | B2 * | 6/2010 | Lai et al. | 361/700 |
| 7,891,414 | B2 * | 2/2011 | Cheng et al. | 165/104.33 |
| 8,047,270 | B2 * | 11/2011 | Xu | 165/104.33 |
| 8,136,245 | B2 * | 3/2012 | Lin et al. | 29/890.032 |
| 8,191,612 | B2 * | 6/2012 | Huang | 165/80.3 |
| 8,286,693 | B2 * | 10/2012 | Whitney et al. | 165/104.21 |
| 2006/0144561 | A1 * | 7/2006 | Lin et al. | 165/80.3 |
| 2006/0207747 | A1 * | 9/2006 | Lin | 165/80.3 |
| 2007/0215327 | A1 * | 9/2007 | Lai et al. | 165/104.33 |
| 2007/0261244 | A1 | 11/2007 | Cheng et al. | |
| 2007/0267177 | A1 * | 11/2007 | Lin et al. | 165/104.21 |
| 2008/0216990 | A1 | 9/2008 | Min et al. | |
| 2009/0266513 | A1 * | 10/2009 | Xiong et al. | 165/80.3 |
| 2010/0051236 | A1 * | 3/2010 | Lin et al. | 165/104.21 |
| 2011/0056658 | A1 * | 3/2011 | Lin et al. | 165/104.26 |
| 2011/0114293 | A1 * | 5/2011 | Lin et al. | 165/104.26 |

* cited by examiner

HEAT CONDUCTING STRUCTURE WITH COPLANAR HEATED PORTION, MANUFACTURING METHOD THEREOF, AND HEAT SINK THEREWITH

CROSS REFERENCES RELATED TO THE APPLICATION

This application is a divisional application of U.S. patent application Ser. No. 12/562,352 filed on Sep. 18, 2009.

BACKGROUND OF THE INVENTION

1. Field of the Invention

The present invention relates to a heat conducting structure, and more particularly to a heat conducting structure having a heat pipe, and a manufacturing method of the heat conducting structure.

2. Description of Related Art

In general, an electronic component generates heat during its operation. As science and technology advance, the functions and performance of electronic products are enhanced, and the heat generated by the electronic products becomes increasingly larger, so that most electronic components need a heat dissipating device for controlling a working temperature to maintain normal operations of electronic components. For example, a heat pipe filled with a working fluid for conducting heat is one of the common heat conducting devices.

With reference to FIG. 1 for a conventional heat sink, the heat conducting structure 1*a* of the heat sink 10 comprises a heat conducting base 10*a* and a plurality of heat pipes 20*a*, wherein the heat conducting base 10*a* includes a plurality of ditches 11*a* disposed thereon, and the heat pipes 20*a* are substantially U-shaped and embedded into the ditches 11*a*. In addition, a plurality of fins 30*a* having through holes are sheathed onto the heat pipe 20*a*, such that the heat conducting base 10*a* is attached onto a heat-generating electronic component, and the heat sink 1*a* can dissipate the heat produced by the heat-generating electronic component.

In the aforementioned structure, the heat pipes 20*a* are embedded into the heat conducting base 10*a* to facilitate attaching the heat pipes 20*a* and combining the heat generating electronic component. However, the heat conducting base 20*a* not just increases the overall weight of the heat sink 1*a* only, but also extends the heat conduction path and retards the heat dissipation rate. Furthermore, the installation of the heat conducting base 20*a* also incurs a higher manufacturing cost of the heat sink 1*a*.

In view of the aforementioned shortcomings of the related art, the inventor of the present invention based on years of experience in the related industry to conduct extensive researches and experiments, and finally provided a feasible solution in accordance with the present invention to overcome the shortcomings of the related art.

SUMMARY OF THE INVENTION

Therefore, it is a primary objective of the present invention to provide a heat conducting structure with a coplanar heated portion capable of reducing its overall weight and heat conduction path to lower the manufacturing cost of a heat sink and enhance the heat dissipating efficiency of the heat sink.

To achieve the foregoing objective, the present invention provides a heat conducting structure with a coplanar heated portion, comprising a plurality of heat pipes and an adhesive, wherein each heat pipe includes an evaporating section, a contact plane formed at the evaporating section, and an attaching plane formed adjacent to the contact plane, and the heat pipes are arranged adjacent with each other in a row by the contact plane, and the adhesive is coated onto and combined with the contact plane of any two adjacent heat pipes, and a flush and co-planar heated portion is formed at each attaching plane of the heat pipes.

To achieve the foregoing objective, the present invention provides a heat sink with a heat conducting structure, comprising an adhesive, a plurality of heat pipes and a plurality of fins, wherein each heat pipe includes an evaporating section and a condensing section, and a contact plane and an attaching plane adjacent to the contact plane are formed on the evaporating section, and the heat pipes are arranged in parallel with each other and disposed adjacent to the contact plane, and the adhesive is coated and coupled to the contact plane of any two adjacent heat pipes, and each attaching plane of the heat pipes has a flush and co-planar heated portion, and a plurality of fins are arranged parallel to each other in a row and passed through the condensing section of the heat pipes.

Compared with the related art, the present invention has the evaporating section formed and coupled onto the heat pipe and the contact surface coated with the adhesive, such that after the adhesive is combined with the evaporating section of the heat pipe, the heat conducting structure with a flush and co-planar heated portion is formed. Unlike the related art that embeds the heat pipe into the heat sink of the heat conducting base, the heat conduction of the heat sink in accordance with the invention no longer requires any heat conducting base, and thus the invention can reduce the heat conduction path and improve the heat conduction rate. In addition, no heat conducting base is required, and thus the overall weight and manufacturing cost of the heat sink can be reduced significantly to improve the practicability and cost-effectiveness of the present invention.

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

Figure 1:
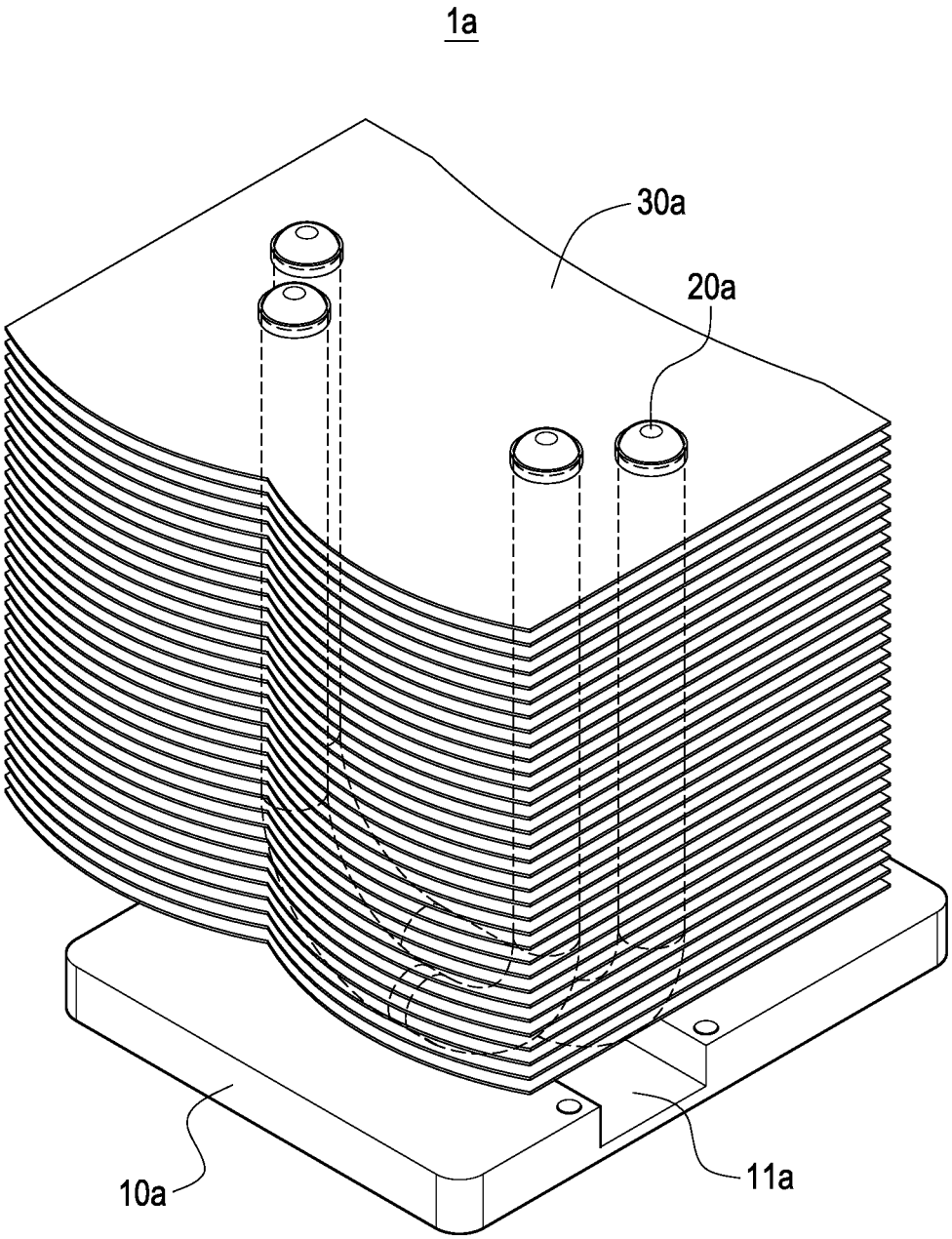
FIG.1 PRIOR ART
FIG. 1 shows a conventional heat pipe heat sink.
Figure 2:
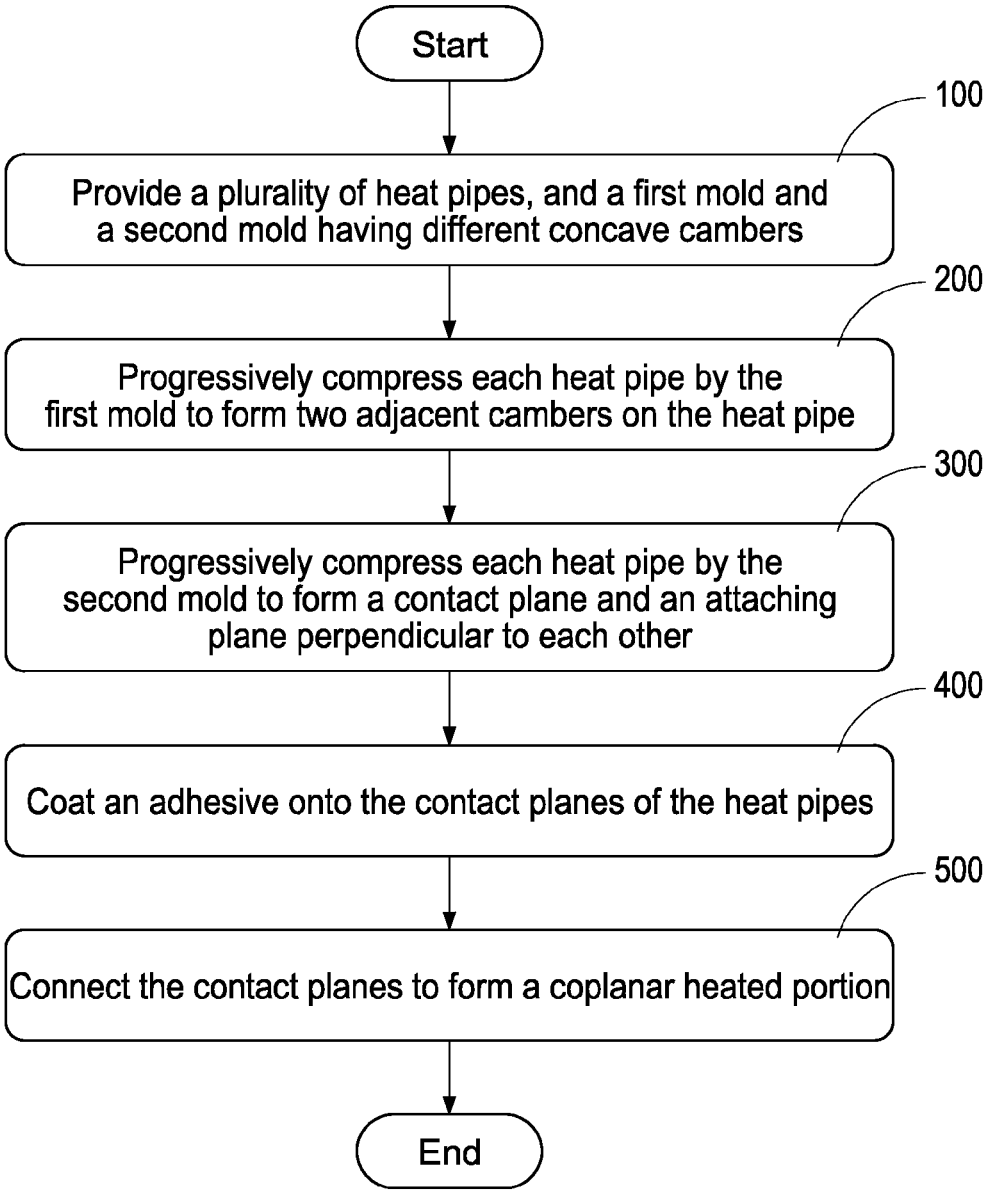
FIG. 2 is a flow chart of manufacturing a heat conducting structure with a coplanar heated portion in accordance with the present invention.
Figure 3:
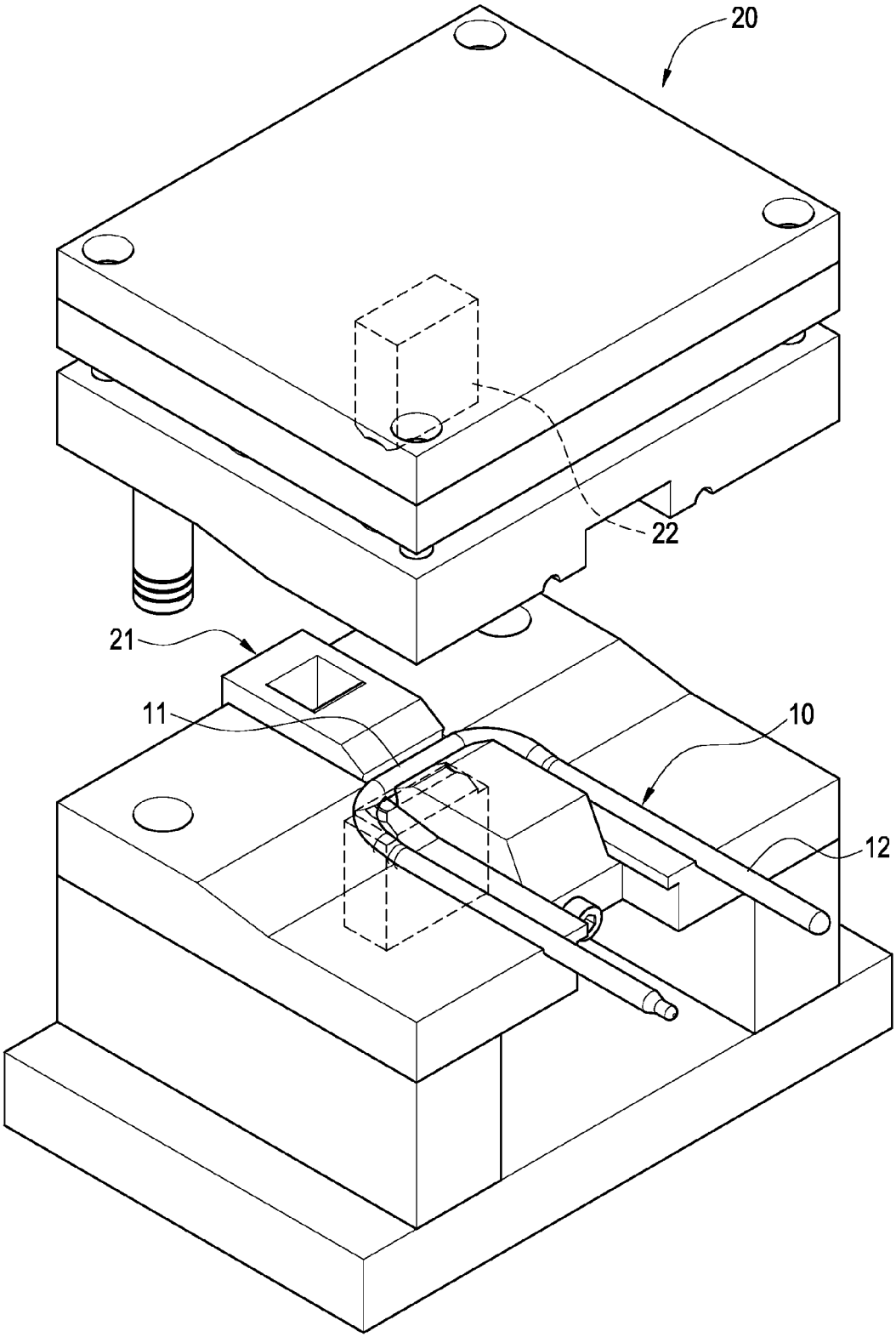
FIG. 3 is a schematic view showing a press module of a heat conducting structure with a coplanar heated portion in accordance with the present invention.
Figure 4:
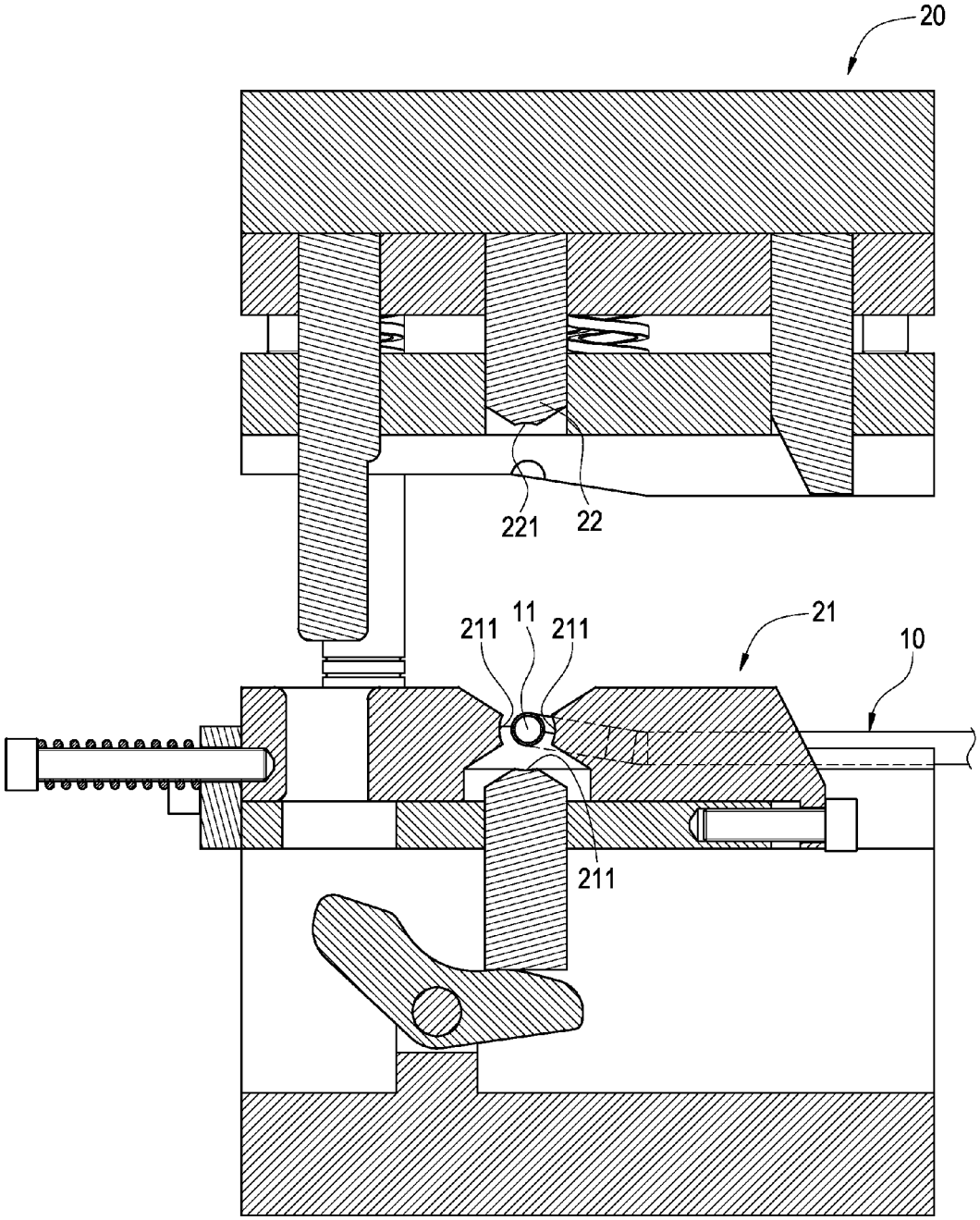
FIG. 4 is a cross-sectional view of FIG. 3.
Figure 5:
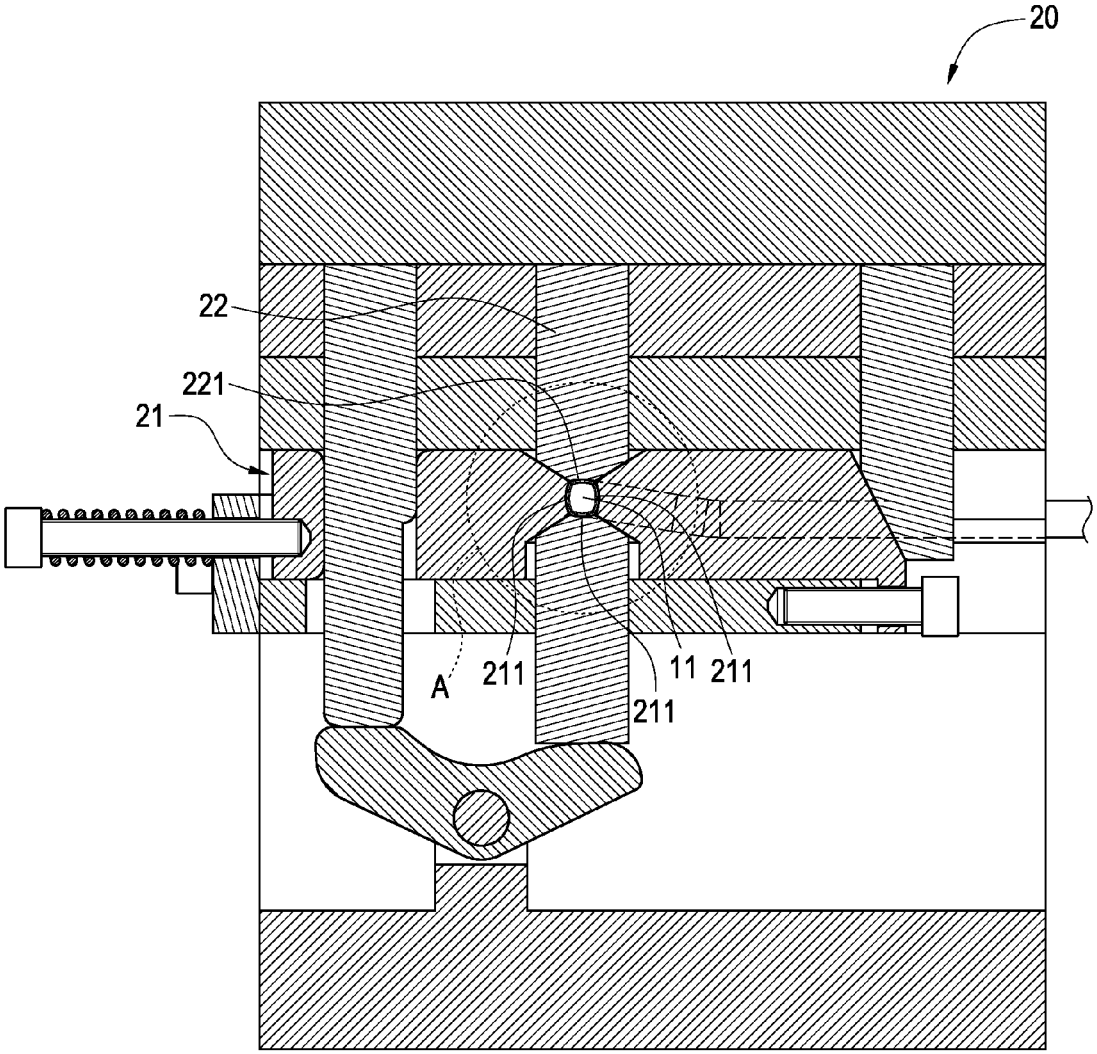
FIG. 5 is a schematic view of compressing a heat conducting structure with a coplanar heated portion in accordance with the present invention.
Figure 5A:
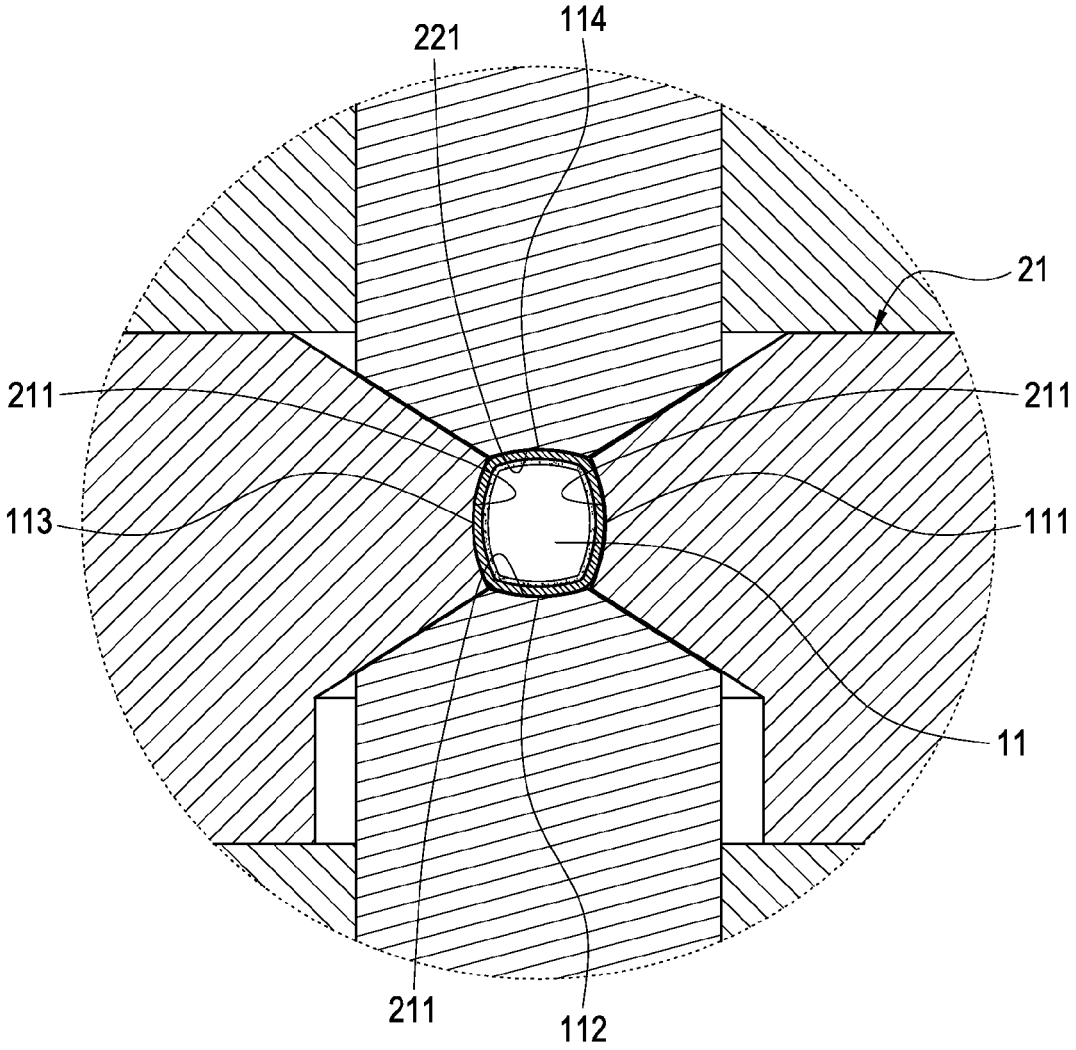
FIG. 5A is a partial enlarged view of a portion A of FIG. 5.
Figure 5B:
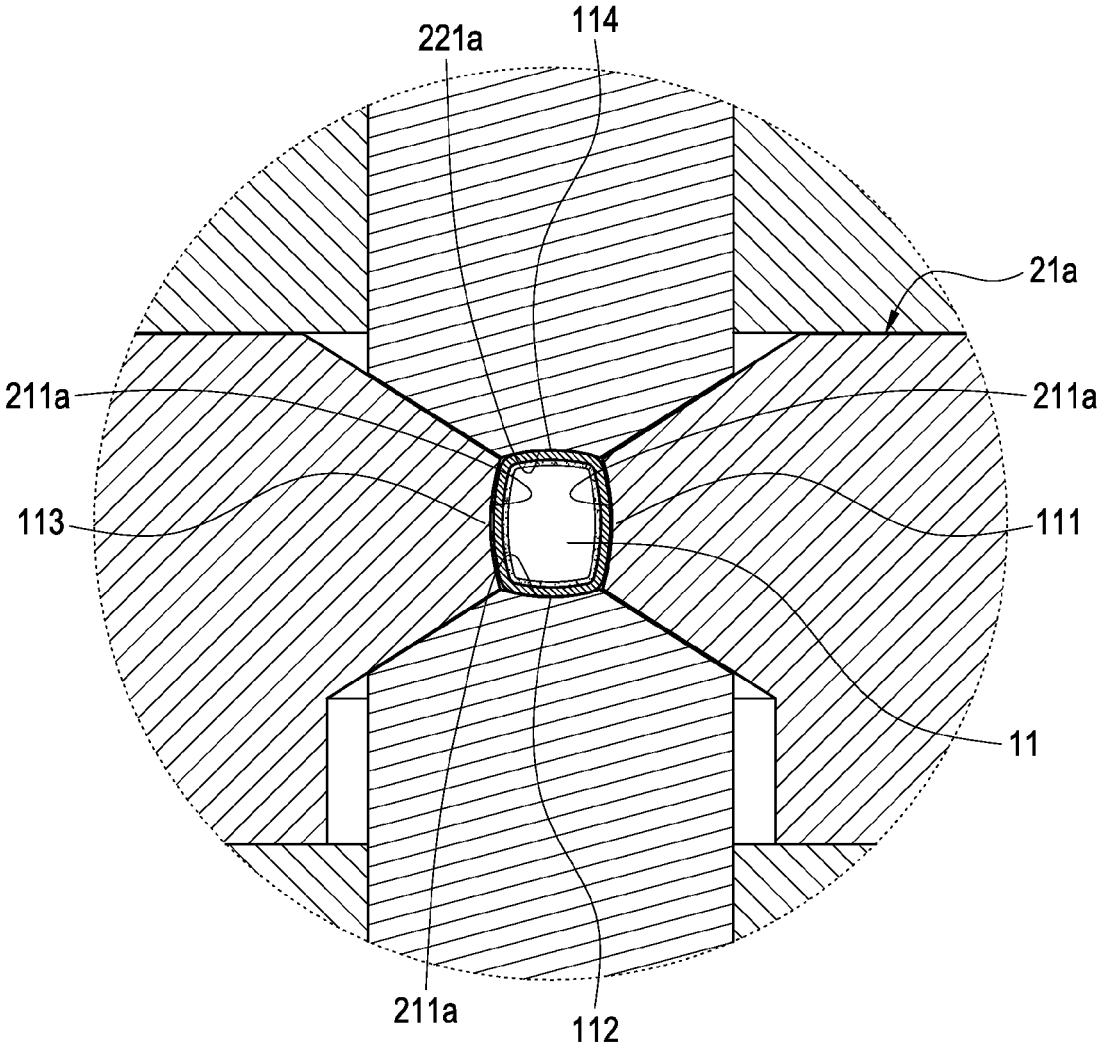
FIG. 5B is a schematic view of compressing a concave camber compression.
Figure 6:
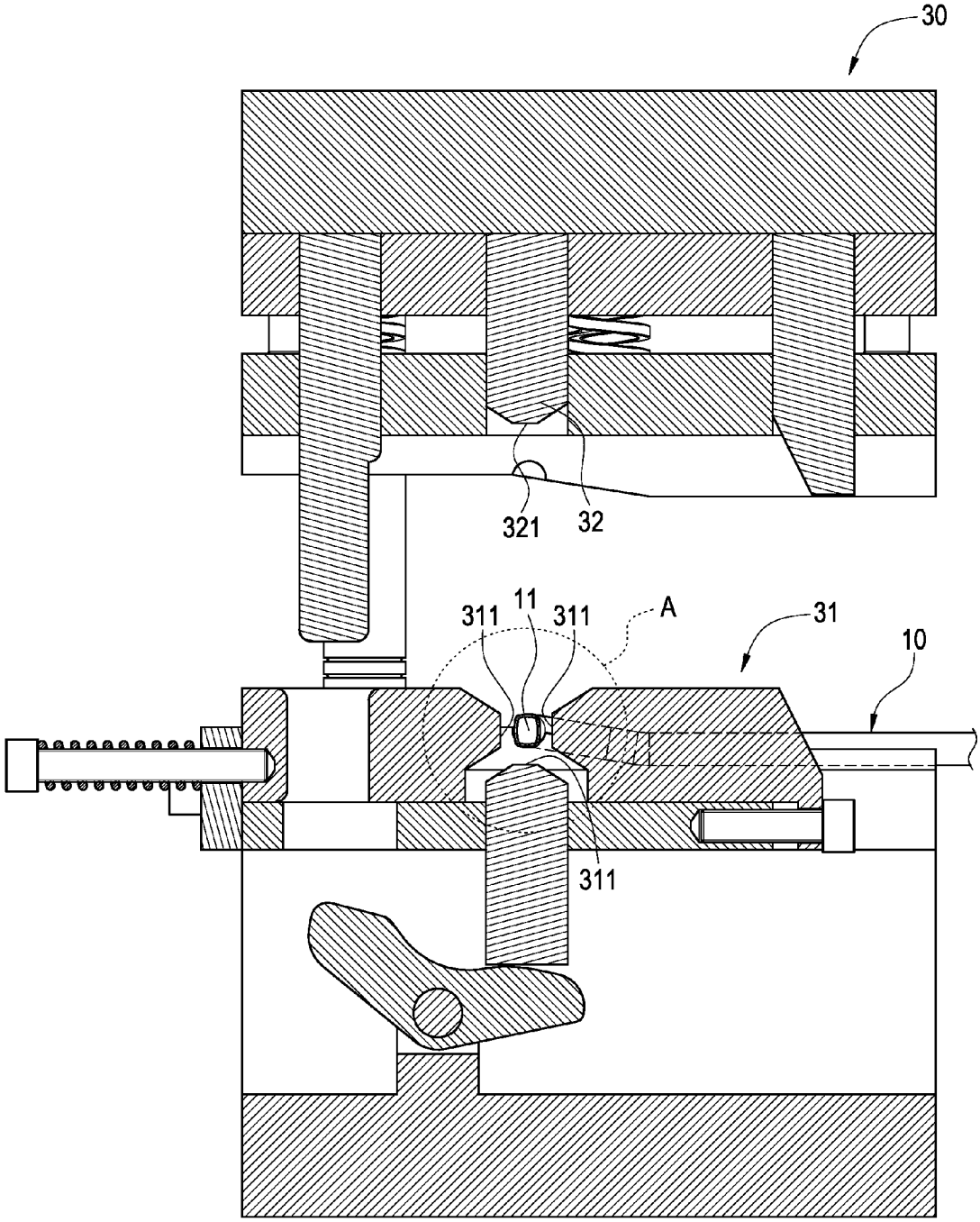
FIG. 6 is a schematic view of compressing a heat conducting structure with a coplanar heated portion in accordance with the present invention.
Figure 6A:
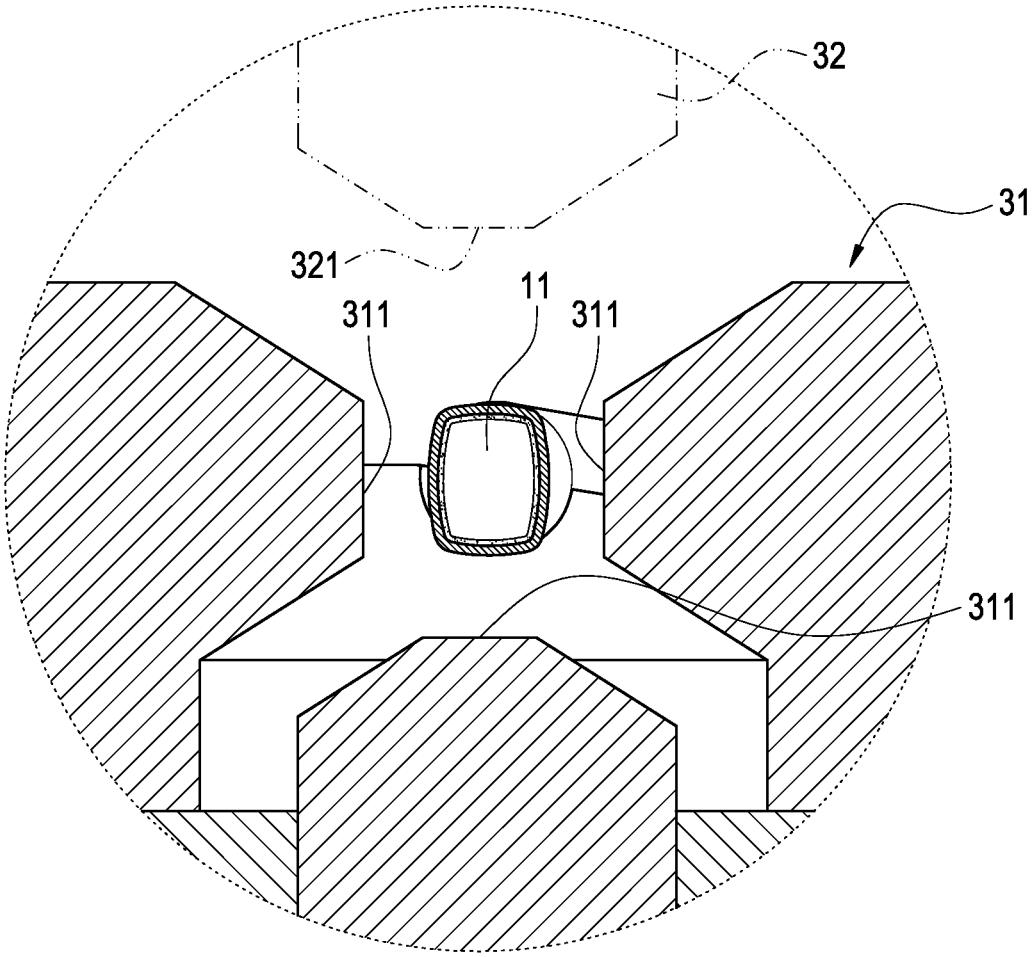
FIG. 6A is a partial enlarged view of a portion A of FIG. 6.
Figure 7:
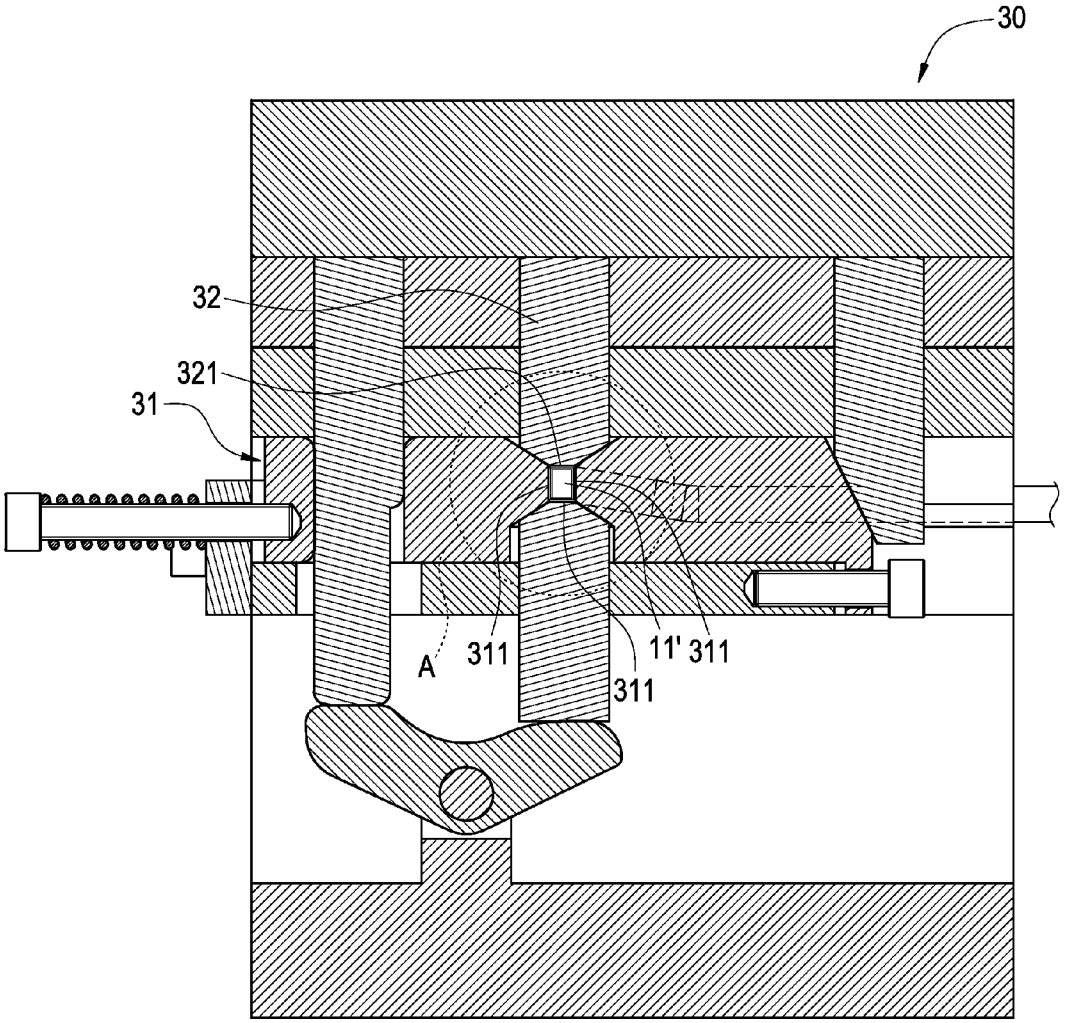
FIG. 7 is a schematic view of compressing a heat conducting structure with a coplanar heated portion in accordance with the present invention.
Figure 7A:
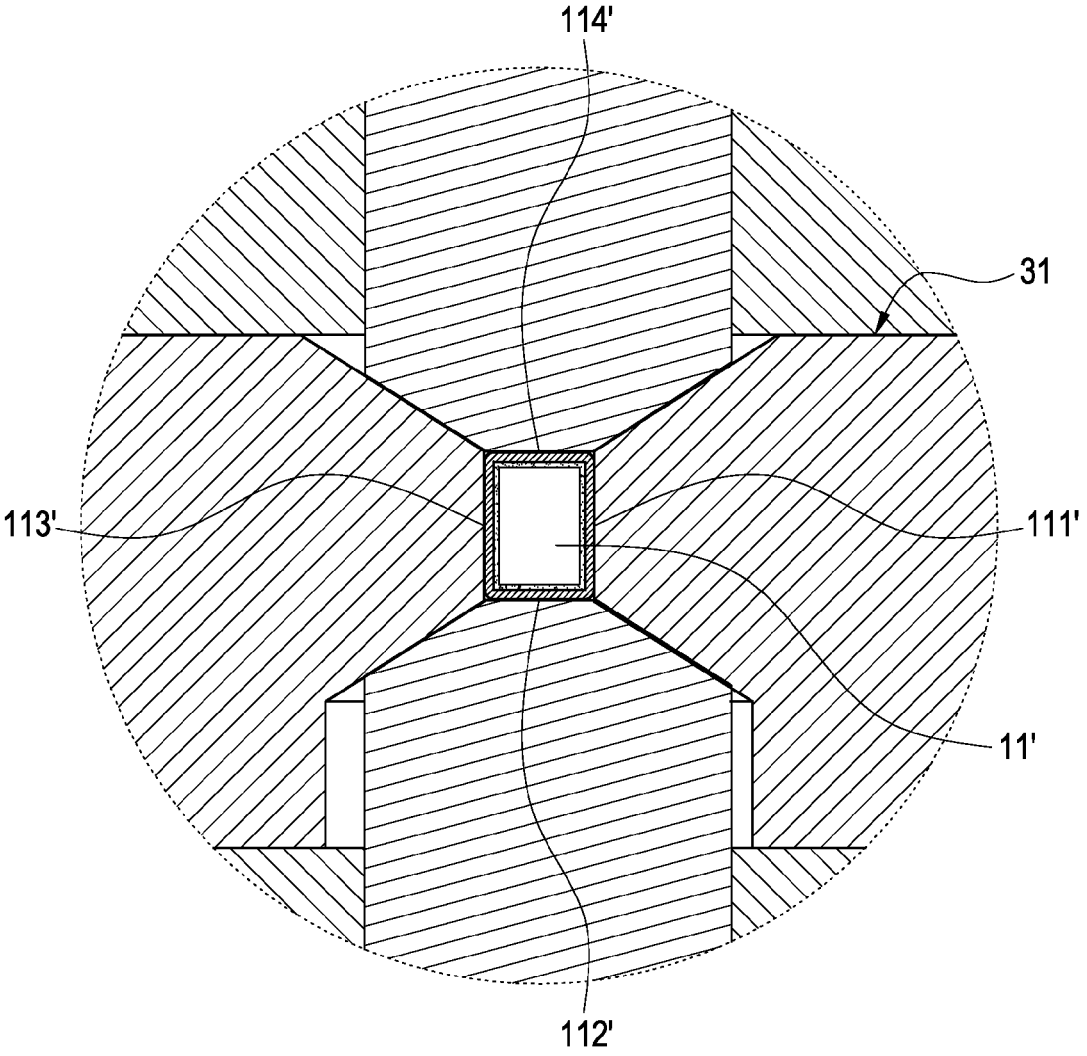
FIG. 7A is a partial enlarged view of a portion A of FIG. 7.
Figure 8:
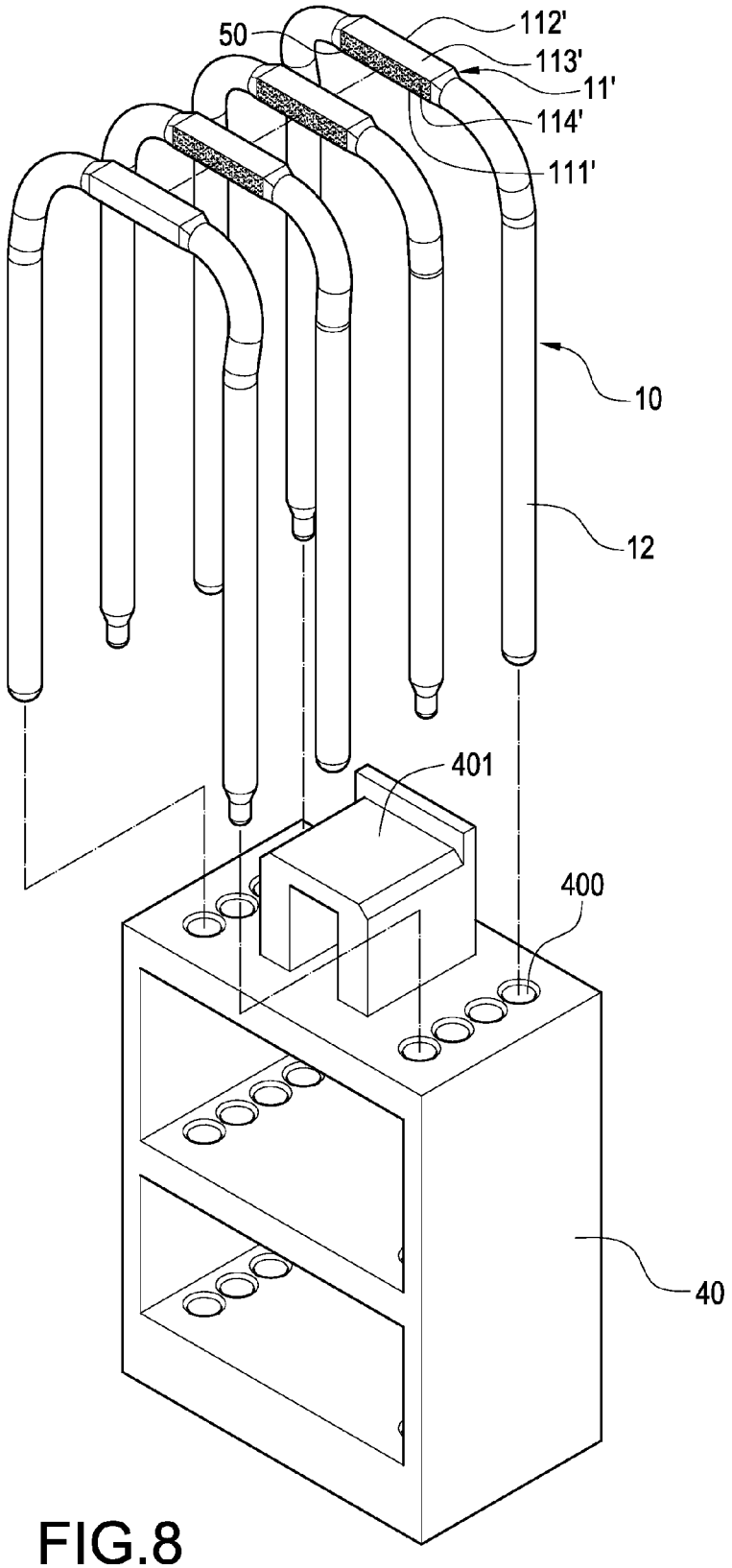
FIG. 8 is a schematic view of installing a heat conducting structure with a coplanar heated portion in accordance with the present invention.
Figure 9:
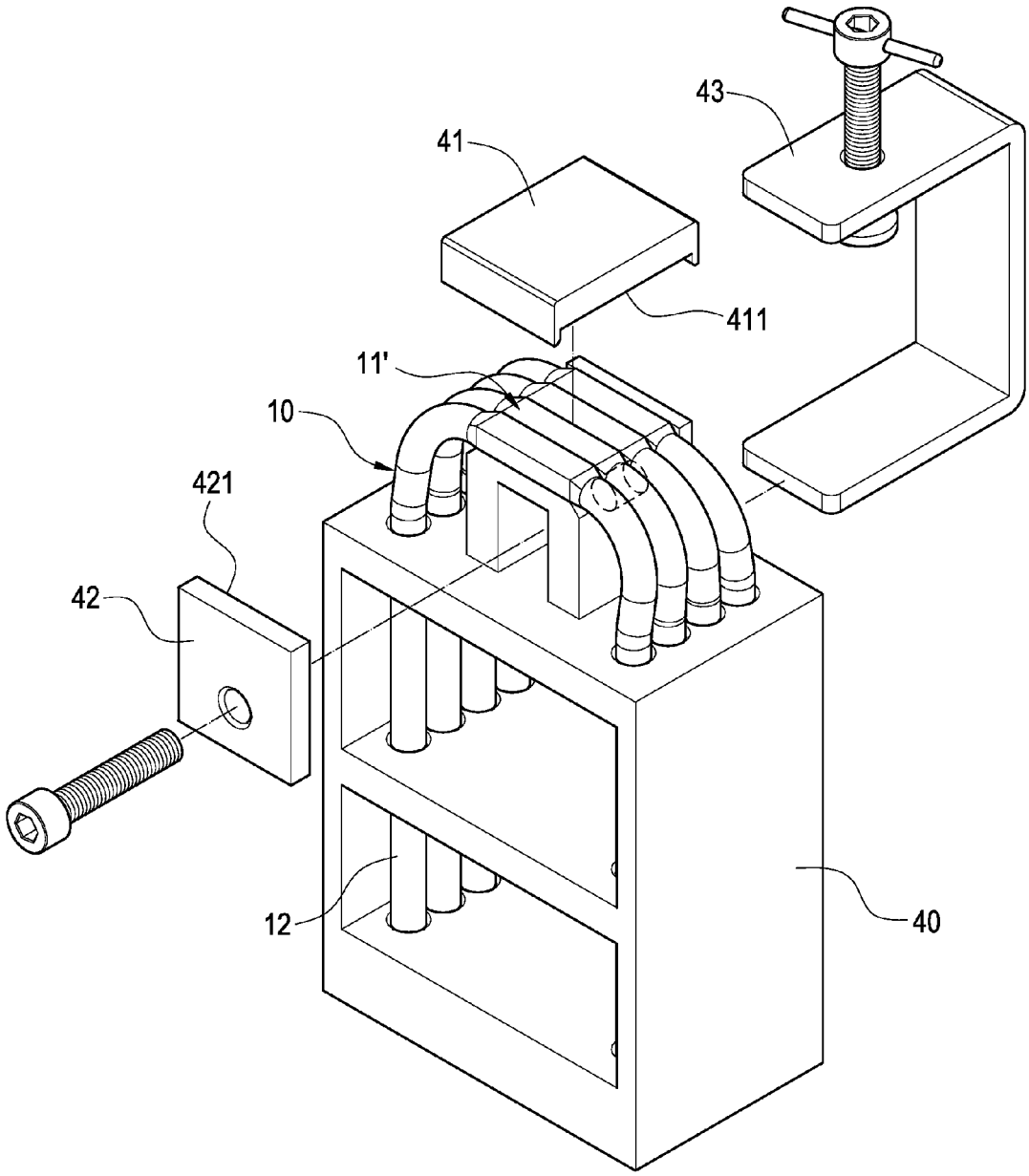
FIG. 9 is a schematic view of securing a heat conducting structure with a coplanar heated portion in accordance with the present invention.
Figure 10:
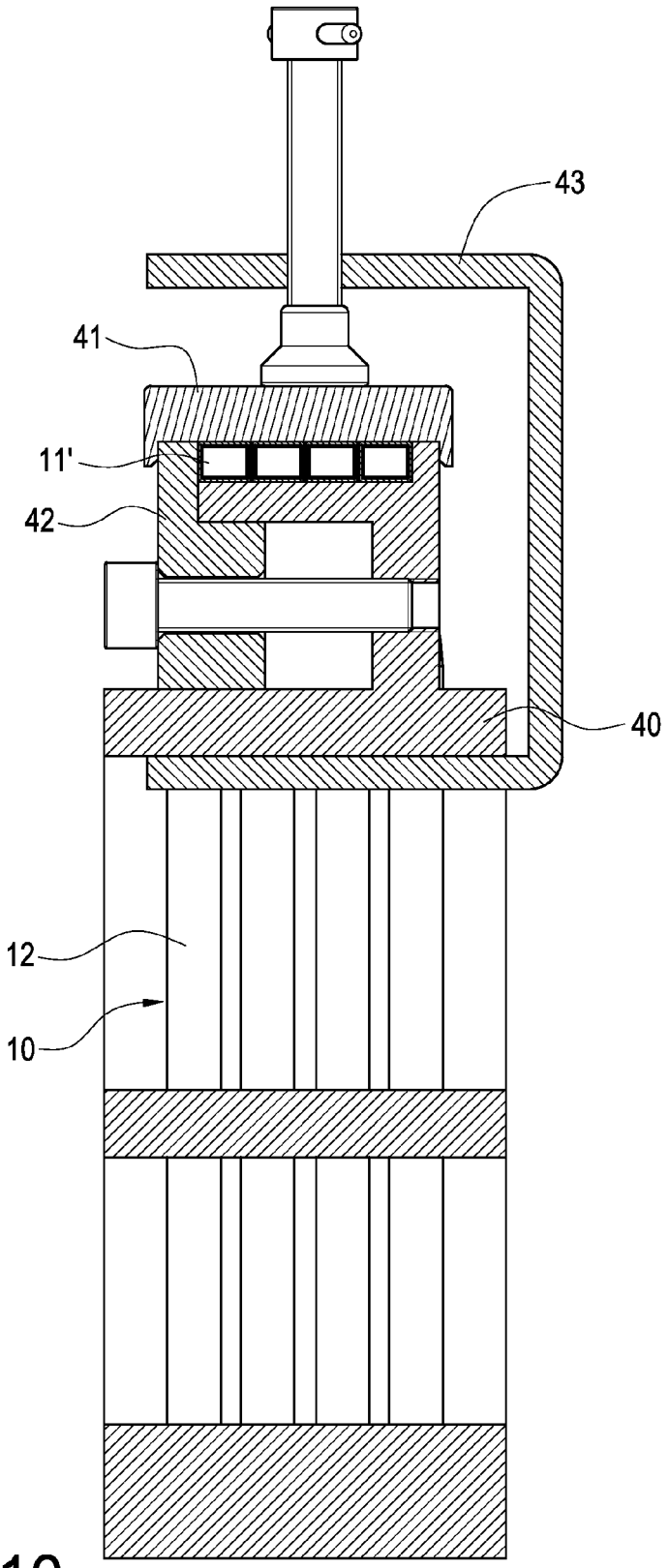
FIG. 10 is a cross-sectional view of securing a heat conducting structure with a coplanar heated portion in accordance with the present invention.

With reference to FIGS. 2 to 8 for flow charts and schematic views of manufacturing a heat conducting structure with a coplanar heated portion in accordance with the present invention, a plurality of heat pipes 10, a first mold 20 and a second mold 30 are provided first (Step 100). The heat pipe 10 is U-shaped and includes an evaporating section 11 and two condensing sections 12, and the first mold 20 includes a first platform 21 and a first compression rod 22, wherein the first platform 21 of the first mold 20 can have different concave cambers 211, 211*a*, or a plurality of first molds 20 are used, and the different concave cambers 211, 211*a* are formed on the first molds 20 respectively (as show in FIGS. 5A and 5B), and the first compression rod 22 can have a concave camber 221. The second mold 30 includes a second platform 31 and a second compression rod 32, and surfaces of the second platform 31 and the second compression rod 32 are provided with planar surfaces 311, 321.

With reference to FIGS. 3 to 5 and 5A, the heat pipe 10 is placed onto the first platform 21, and the first mold 20 is used for performing a progressive compression to the evaporating section 11 of the heat pipe 10 (Step 200) to progressively form the required camber on the evaporating section 11. In this preferred embodiment, the first mold 20 includes two sets of corresponding concave cambers, such that after the first mold 20 is compressed, the first compression rod 22 and the concave cambers 221, 211 of the first platform 21 perform a compression procedure to the evaporating section 11 of the heat pipe 10 to form adjacent cambers 111~114 on the evaporating section 11, and then other concave cambers 221*a*, 211*a* are used for performing the compression procedure to the cambers 111~114. If the first compression rod 22 has not compressed the evaporating section 11 of the heat pipe 10, then the evaporating section 11 only has the cambers 111~113 formed thereon.

With reference to FIGS. 6, 6A, 7 and 7A, the heat pipe 10 compressed progressively by the first mold 20 is placed onto the second platform 31 in the second mold 30, and the second mold 30 is used for compressing the cambers 111~114 of the evaporating section 11 of the heat pipe 10 (Step 300), wherein a contact surface of the second platform 31 of the second mold 30 and the evaporating section 11 is a planar surface 311, and a contact surface of the second compression rod 32 and the evaporating section 11 of the heat pipe 10 is also a planar surface 321. In this preferred embodiment, the second mold 30 includes two sets of opposite planar surfaces, such that after the second mold 30 is compressed, the planar surfaces 321, 311 of the second compression rod 32 and the second platform 31 can be used for compressing the evaporating section 11 of the heat pipe 10, and the cambers 111~114 form two sets of planes perpendicular to each other, and the compressed evaporating section 11' having a rectangular cross-section includes two contact planes 112', 114' and two attaching planes 111', 113' perpendicular to the two contact planes 112', 114'. If the second mold 30 just compresses the cambers 111~113, the evaporating section 11' of the heat pipe 10 has a cross-section substantially in the shape of D.

After the evaporating section 11 of the heat pipe 10 is compressed by the first mold 20 and the second mold 30, the required shape is achieved after the following connection. The remaining heat pipes 10 go through the same process as described above to produce a heat conducting structure with a predetermined quantity of connected heat pipes 10.

With reference to FIGS. 8 to 11 for schematic views of connecting an evaporating section of a heat pipe in accordance with the present invention, an adhesive 50 is coated onto the contact planes 112', 114' of any two adjacent heat pipes 10 according to the required quantity of heat pipes 10 (Step 400), wherein the adhesive 50 is a heat conducting adhesive.

Each contact plane 112', 114' of the heat pipes 10 is put into a tool 40 having a plurality of through holes 400, and the evaporating section 11' of the heat pipe 10 is disposed on a base 401 of the tool 40, and the contact planes 112', 114' are preliminarily coupled by the adhesive 50, and then a press board 41 and a clamp board 42 having a compression plane 411 and a clamping plane 421 are provided for compressing and positioning the evaporating section 11' of the heat pipe 10 (Step 500), and then a C-shaped clamp 43 is used for fixing the press board 41. After the adhesive 50 is solidified to combine the evaporating section 11' of the heat pipe 10, the heat pipes 10 can be removed from the tool 40.

Figure 11:
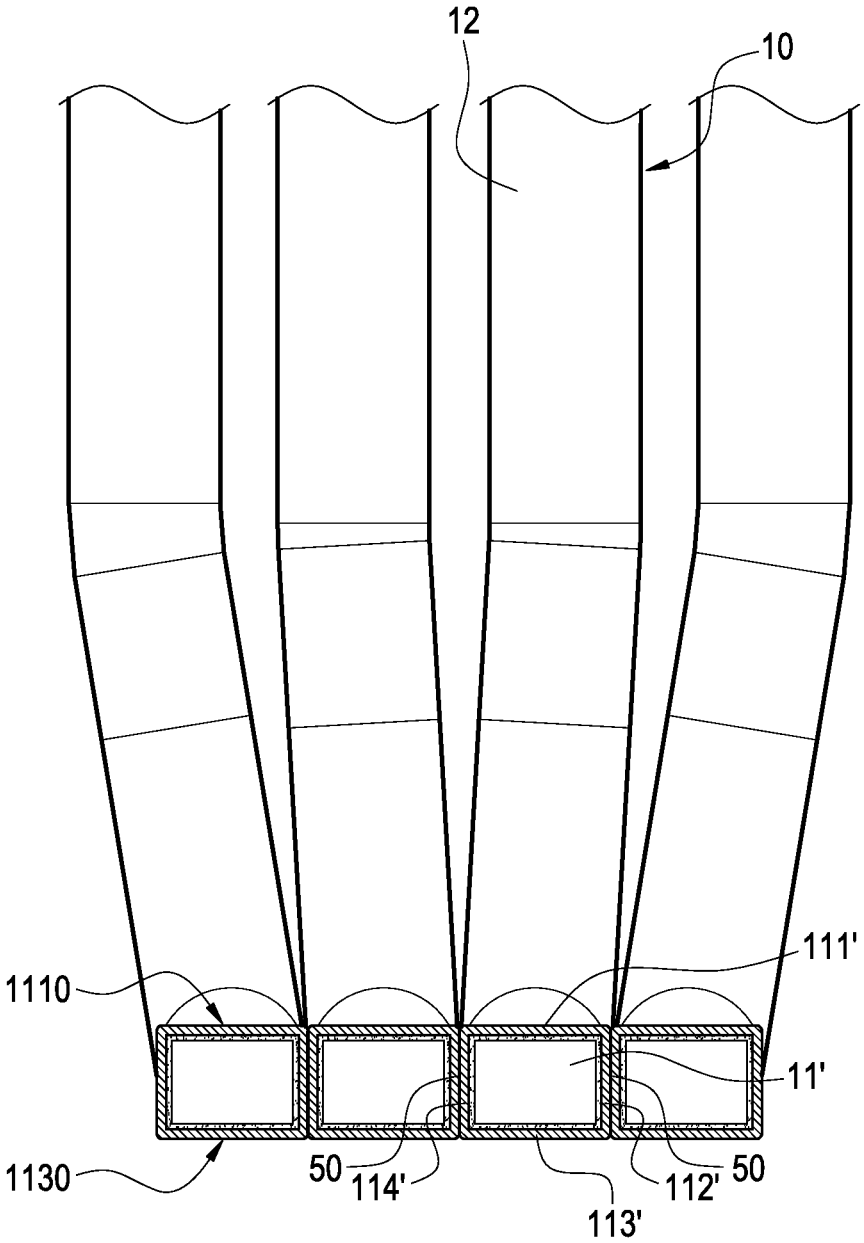
FIG. 11 is a cross-sectional view of a heat conducting structure with a coplanar heated portion in accordance with the present invention.

With reference to FIG. 11 for a partial cross-sectional view of a heat conducting structure with a coplanar heated portion in accordance with the present invention, after the tool 40 is positioned, the evaporating sections 11' of the heat pipes 10 are arranged adjacent to each other in a row by the contact surfaces 112', 114', and the attaching plane 113' of the evaporating section 11' of the heat pipes 10 is flush to form a co-planar heated portion 1130 for attaching a heat generating electronic component (not shown in the figure). In addition, an attaching plane 113' of the evaporating section 11' of the heat pipes 10 is also flush and co-planar to form a holding section 1110 provided for clamping a fixing element (not shown in the figure) to be fixed onto the heat generating electronic component.

Figure 12:
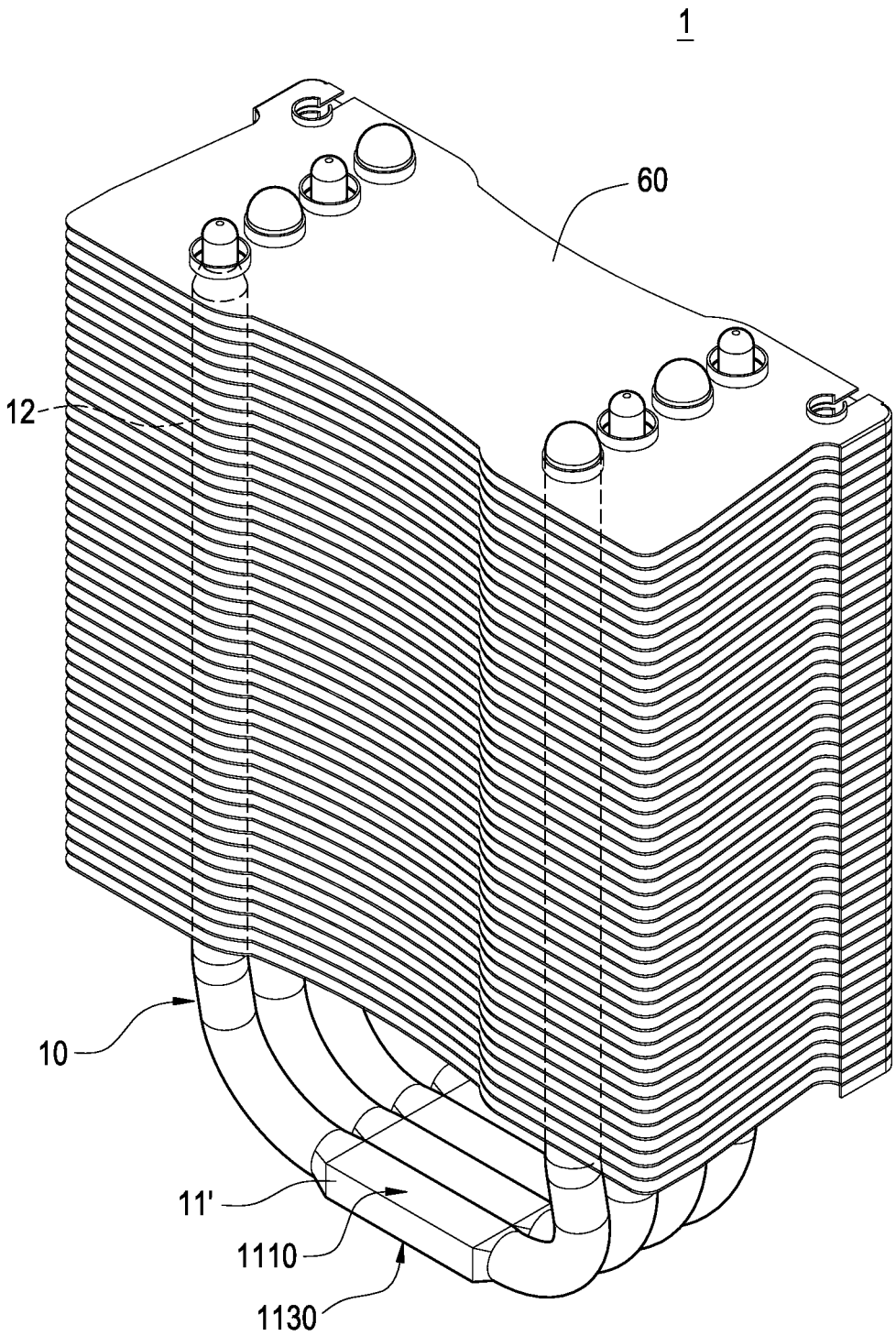
FIG. 12 is a perspective view of a heat sink of a heat conducting structure with a coplanar heated portion in accordance with the present invention.

With reference to FIG. 12 for a heat sink of a heat conducting structure with a coplanar heated portion, the condensing section 12 of the heat pipes 10 is installed separately and has a circular cross-section, and a plurality of fins 60 are passed and disposed onto the condensing sections 12 to form a heat sink 1.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A heat sink comprising:

a plurality of fins (60); and a heat conducting structure comprising a plurality of U-shaped heat pipes (10) and an adhesive (50), and each heat pipe (10) having an evaporating section (11) and two condensing sections (12) respectively extended from two distal ends of the evaporating section, wherein two contact planes (112', 114') are formed on opposite sides of the evaporating section (11), respectively, and an attaching plane (113') is formed on the evaporating section (11) to be located between and adjacent to the two contact planes (112', 114'), and the heat pipes (10) are arranged in a row by making evaporating sections (11) thereof to be contacted with each other and a separation to be formed between any two adjacent condensing sections (12) extended from same sides of the evaporating sections (11) while the plurality of fins (60) are passed parallelly to and engaged with a plurality of separations between the condensing sections (12), and the adhesive (50) is coated onto and combined with two corresponding contact planes (112', 114') of any two adjacent heat pipes (10), and a coplanar heated portion is formed by a plurality of attaching planes (113') of the heat pipes (10).

2. The heat sink as recited in claim 1, wherein the evaporating section (11) of the heat pipe (10) has a substantially rectangular cross-section.

3. The heat sink as recited in claim 1, wherein the evaporating section (11) of the heat pipe (10) has a cross-section substantially in the shape of D.

4. The heat sink n as recited in claim 1, wherein the condensing section (12) has a cross-section substantially in a circular shape.

* * * * *